US006322277B1

(12) United States Patent
Jennings

(10) Patent No.: US 6,322,277 B1
(45) Date of Patent: Nov. 27, 2001

(54) CLAMP FOR INTERCONNECTING COMPONENTS OF SHORING APPARATUS

(75) Inventor: Robert Jennings, Des Moines, IA (US)

(73) Assignee: Wilian Holding Company, Des Moines, IA (US)

( * ) Notice: Subject to any disclaimer, the term of this patent is extended or adjusted under 35 U.S.C. 154(b) by 0 days.

(21) Appl. No.: 09/524,480

(22) Filed: Mar. 13, 2000

(51) Int. Cl.[7] ..... F16B 1/00

(52) U.S. Cl. ..... 403/49; 52/656.9; 403/174; 403/359.6

(58) Field of Search ..... 52/656.9, 655.1; 403/174, 175, 178, 170, 49, 359.6

(56) References Cited

U.S. PATENT DOCUMENTS 2,546,929 * 3/1951 Nampa ..... 403/49
3,939,300 * 2/1976 Hawkins ..... 174/42
5,078,532 * 1/1992 Williams ..... 403/174
5,315,805 * 5/1994 Harsch ..... 403/170
5,388,666 * 2/1995 Schworer ..... 182/186.6
5,713,687 2/1998 Schworer .

* cited by examiner

*Primary Examiner*—Lynne H. Browne
*Assistant Examiner*—Aaron Dunwoody
(74) *Attorney, Agent, or Firm*—Kent A. Herink; Daniel A. Rosenberg

(57) ABSTRACT

A clamp for interconnecting two components of a support apparatus such as components of a shoring apparatus for concrete foaming systems. A clamp member having swill, arm jaw is received for pivotal movement in a housing that is secured to one of the components. A plurality of flutes disposed at an angle to the pivot axis of the clamp member are received in coacting recesses in the housing. Axial movement of the clamp member will pivot the swing arm and a coacting, moveable jaw toward a fixed jaw formed in the housing to releasably secure the clamp to the other component.

9 Claims, 5 Drawing Sheets

Fig. 7A 44 Fig. 7C

CLAMP FOR INTERCONNECTING COMPONENTS OF SHORING APPARATUS

BACKGROUND OF THE INVENTION

1. Field of the Invention

The invention relates generally to shoring apparatus used in forming concrete structures and, more specifically, to a clamp useful in interconnecting components of scaffolding apparatus which includes a moveable jaw that is moved to and held in a clamping position by a fluted pin.

2. Background of the Prior Art

Concrete forming apparatus is in wide use in the construction of buildings, bridges, and other concrete structures. The formwork against which the concrete is formed is often held in place by shores, walers, and the like. In creating, shoring, apparatus having the desired strength, it is common to interconnect vertical and horizontal components of the shoring apparatus. Because of the variety in the size and shape of concrete structures formed using the shoring apparatus, it is advantageous to have the ability to interconnect the various components of the shoring apparatus in a wide variety of configurations without unduly multiplying the number of distinct components that are required to assemble the shoring apparatus of the desired diversity. Accordingly, a number of attempts have been made to design clamps or couplings for interconnecting components of shoring apparatus that are adjustable to fit a wide variety of configurations. One such coupling, is described in the U.S. Pat. No. 5,713,687. The patent describes a coupling for interconnecting a horizontal panel at any desired position along a pair of vertical shoring posts. The coupling has a mouth formed of a stationary and moveable jaw. The moveable jaw is closed towards the stationary jaw by driving behind the moveable jaw a wedge-shaped tensioning member. The coupling mouth when tensioned by the wedge, engages the vertical shoring post at the desired position. In an alternative embodiment, the wedge includes ribs that run at an angle with respect to the longitudinal axis of the wedge and which engage teeth on the moveable jaw to move it between an opened position and a clamped or tensioned position.

SUMMARY OF THE INVENTION

The invention consists of a clamp for releasably Securing to each other components of a shoring apparatus. The clamp includes a housing that is secured to a first component of the shoring apparatus. The housing has a fixed jaw which projects laterally of the component and a moveable jaw that is mounted in the housing for pivotable movement in a direction which will move the moveable jaw toward and away from the fixed jaw. A clamp member comprises a pin that has a plurality of flutes arranged about its outer periphery and disposed at an angle relative to the longitudinal, pivoting axis of the pin and clamp member. Recesses corresponding to the flutes are formed in the housing and the clamp member is received for guided vertical sliding movement inside the housing wherein the flutes of the pin are received inside the corresponding recesses formed in the housing. Movement of the clamped member along its longitudinal axis results in pivotable movement of the clamped member as a result of the engagement of the flutes with the recesses. A pivot or swing arm of the clamp member projects radially of the pin and has an outer end portion that is received within a corresponding socket in the moveable jaw. Accordingly. longitudinal movement of the clamp member will pivot the pivot arm and thereby move or swing the moveable jaw toward and away front the fixed jaw. The pitch of the flutes relative to the longitudinal axis of the clamp member in combination with the permitted longitudinal axis of the clamp member result in the moveable jaw being pivotable between an open position and a clamping position wherein the pair of jaws engage a mating surface on a second component of the shoring apparatus.

An object of the present invention is to provide a clamp for interconnecting components of a shoring apparatus that is quickly and easily moveable between a released and a clamped position.

Another object of the present invention is to provide a clam for interconnecting components of a shoring apparatus which is durable and provides the requisite strength while being economical to manufacture.

These and other objects of the invention will be made apparent to a person that is skilled in the art upon a review and understanding of this specification, the associated drawings, and the appended claims.

BRIEF DESCRIPTION OF THE DRAWINGS

FIGS. 7A–7C are section view taken along, the lines A–C of FIG. 6

DETAILED DESCRIPTION OF PREFERRED EMBODIMENT

Figure 1:
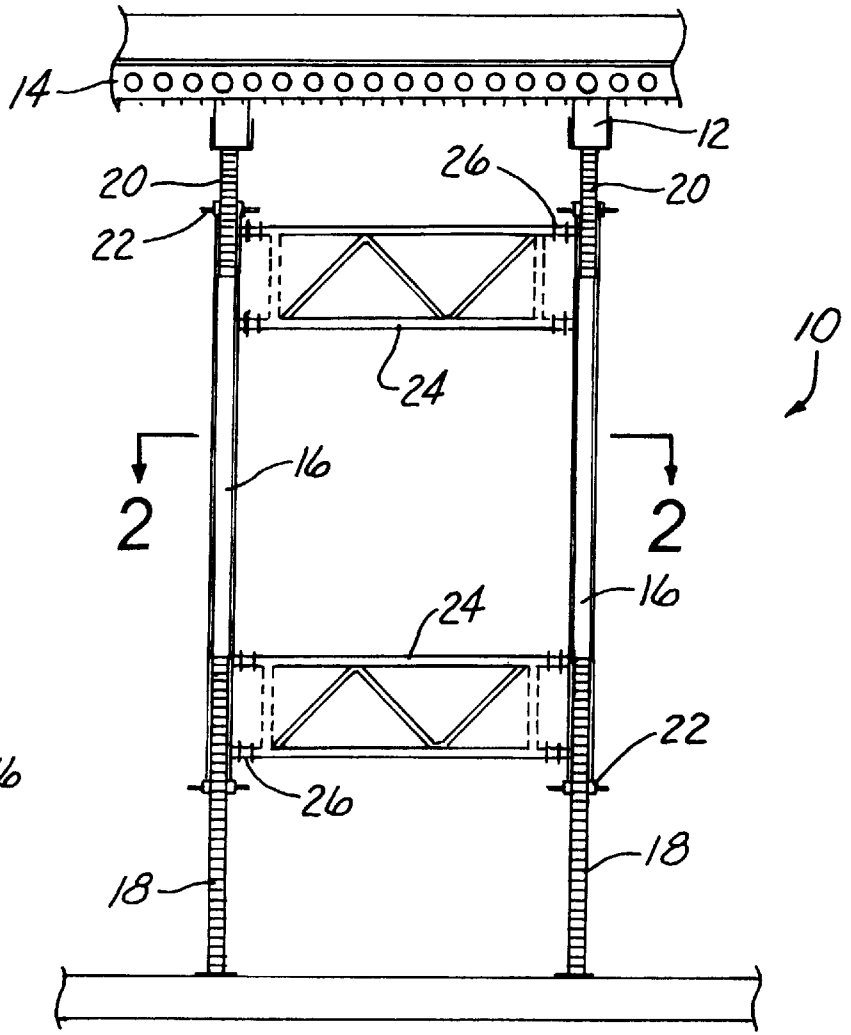
FIG. 1 is an elevational view of a typical shoring apparatus when clamps of the present invention are used to interconnect components of the shoring apparatus.

Referring to the drawings, there is illustrated in FIG. 1 generally at 10, a shoring apparatus for supporting concrete forms such as the beams 12 and 14. The shoring apparatus 10 includes a plurality of shoring posts 16, each of which is supported on a bottom jack 18 and has extended from its tipper end section a top jack 20. The shoring posts 16 are of a fixed length but the total height of the shoring apparatus 10 is adjustable by rotation of a plurality of wing nuts 22 that are threaded about the bottom jacks 18 and top jacks 20 and which abut against the ends of the shoring posts 16.

Figure 2:
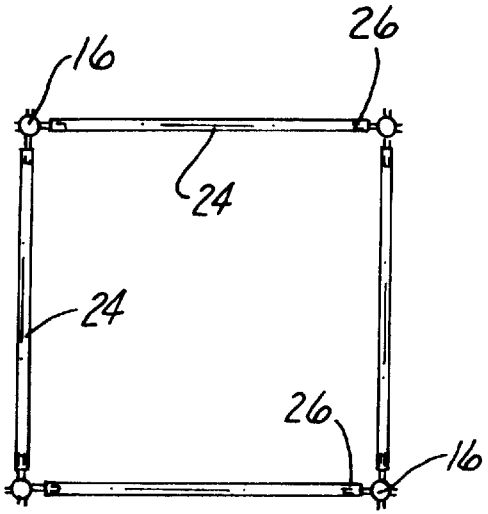
FIG. 2 is a sectional view taken along line 2—2 of FIG. 1

One or more horizontally disposed panels 24 may be interconnected between adjacent shoring posts 16 to provide added strength to the shorting, apparatus 10 and also to provide means for supporting a platform or the like upon which workers can stand who assemble the shoring apparatus 10 and the associated concrete forming apparatus, pour the concrete contained by the forms, and strip the forms after the concrete has set. As illustrated in FIG. 2, a common configuration uses four shoring posts 16 that are interconnected by four panels 24. Because of the need to adapt the various components of the shoring apparatus 10 to assemble shoring systems to support concrete forms in the wide variety of configurations demanded by architects and building contractors, it is cry desirable to be able to interconnect the shoring apparatus components at adjusted positions and to be able to do so quickly and reliably without a sacrifice in strength.

The panels 24 are interconnected with the vertical shoring posts 16 at any desired position along the length of the shoring posts 16 by a plurality of clamping members 26. The clamping members 26 are secured to the ends of the cross-bars of the panels 24 and are adapted to be releasably clamped at adjusted positions on the shoring posts 16.

Figure 3A:
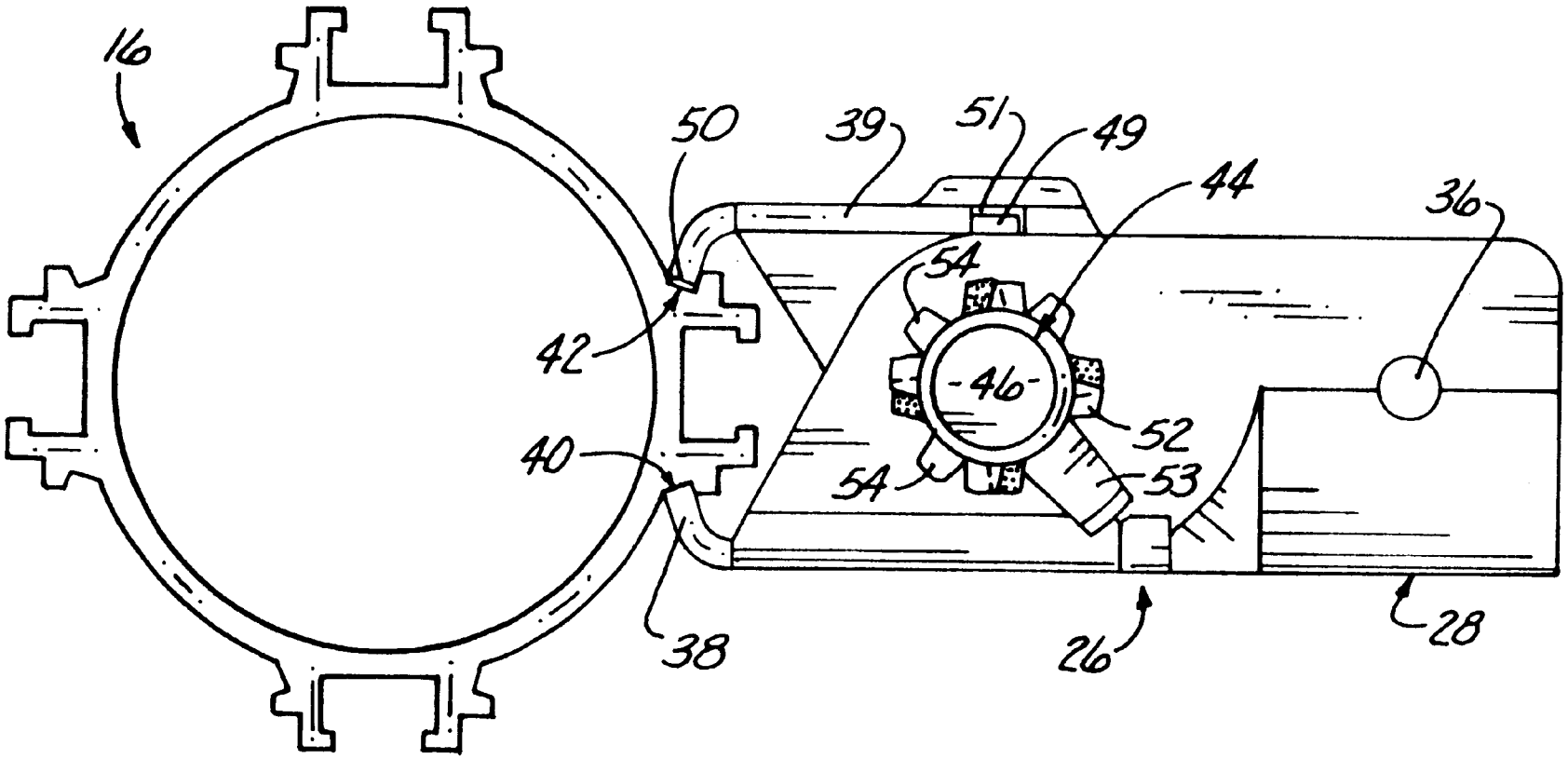
FIGS. 3*a* and 3*b* are enlarged detailed views showing a clamp of the present invention engaged with a shoring post and partially opened for detachment from the shoring post.
Figure 3B:
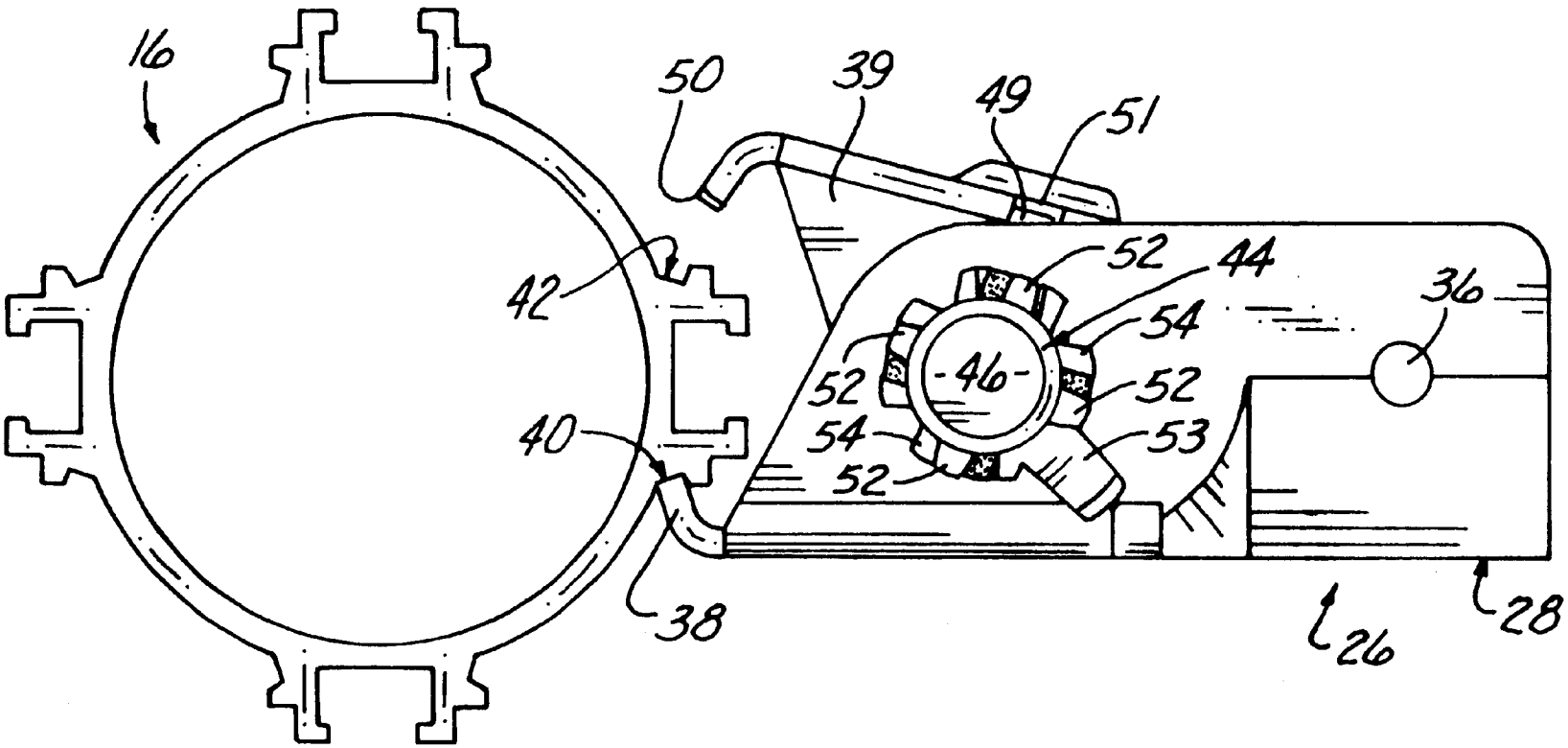
Figure 4:
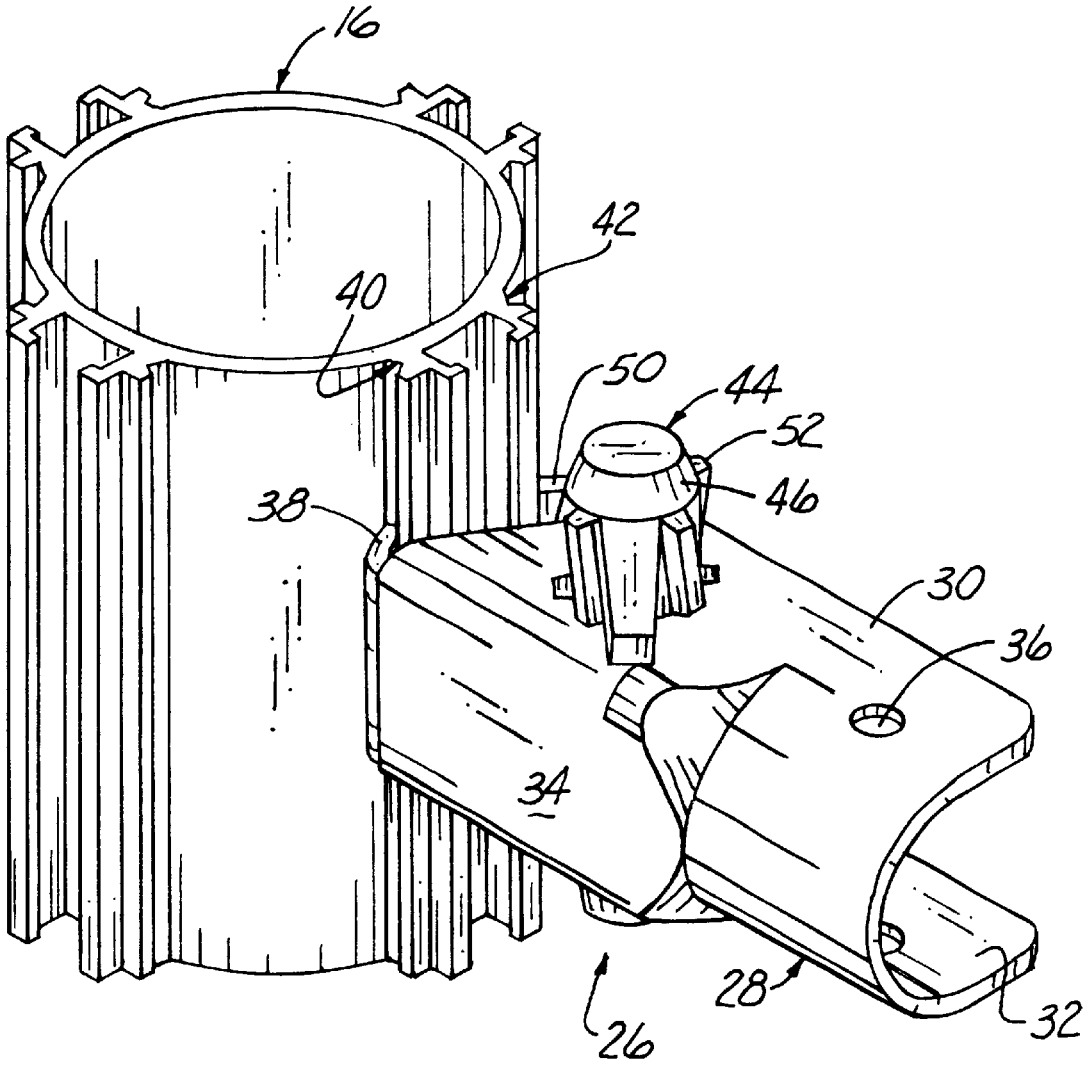
FIG. 4 is a perspective view of the clamp attached to a shoring post, as in FIG. 3*a*.

A detailed view of a clamp 26 is illustrated in FIGS. 3 and 4. the clamp 26 includes a housing 28 that is of a generally U-shape in transverse cross section, having a top section 31, a bottom section 32, and an interconnecting web 34. A throughbore 36 is provided in the top section 30 and bottom section 32 and receives a nut and bolt combination (not shown) or the like to secure the housing 28 to a cross member of a panel 24. The distal end portion of the web 34 is in-turned to form a fixed jaw 38 of the clamp 26. The configuration of the fixed jaw 38 is adapted to securely engage one side of a pair of opposing channels 40 and 42 that are formed in the extrusion that comprises the shoring post 16.

The housing 28 also includes a moveable jaw 39 that is mounted in the housing 28 for pivotal movement toward and away from the fixed jaw 38. An in-turned end portion 50 of the moveable jaw 39 is adapted to securely engage the opposite one of the opposing channels 40 and 42 from the fixed jaw 38.

Figure 5:
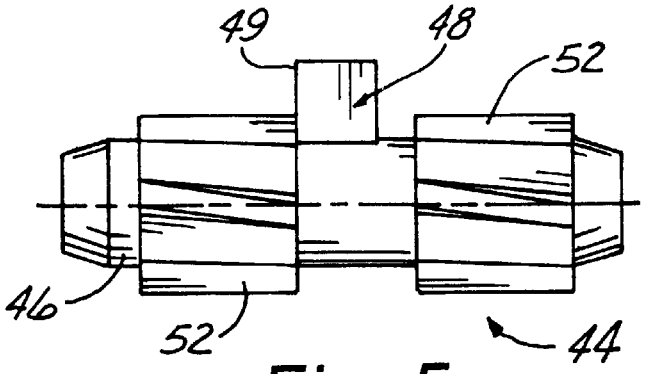
FIG. 5 is an enlarged detail side view of a clamping member of tile present invention.
Figure 6:
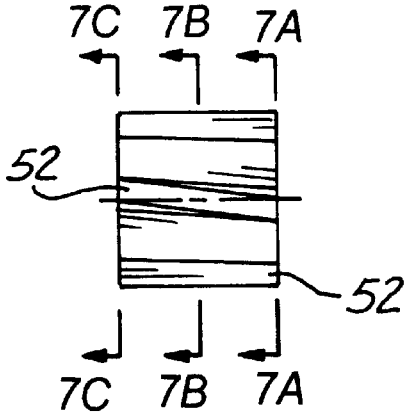
FIG. 6 is a partial view of the flutes corresponding to FIG. 5.

Included in the clamp 26 is a clamp member 44. As best illustrated in FIGS. 5–7, the clamp member 44 includes a pin 46 and a swing arm 48 which extends generally radially from the pin 46. The outer end portion 49 of the swing arm 48 is received in a socket 51 formed in the moveable jaw 39.

The pin 46 is constructed with radially extending, flutes 52 that are arranged in a pair of bands encircling either end portion of the pin 46. The flutes 52 are arranged in pairs on opposite lateral sides of the pin 46 so that each of the bands of flutes 52 includes a total of four flutes 52 (FIG. 7). In the preferred embodiment, the flutes 52 are oriented 90° away form the adjacent flutes 52. The flutes 52 are disposed at an angle relative to the longitudinal axis of the pin 46. The flutes 52, accordingly, act as threads on the pin 46.

Referring back to FIG. 3, the top plate 30 and the bottom plate 32 of the housing 28 of tile clamp 26 are formed with recesses 54 corresponding to the flutes 52, with tile recesses 54 of the top plate 30 engaging the flutes 52 in the top band of the clamp member 44 and the recesses 54 in the bottom plate 32 engaging with the flutes 52 of the bottom band of the clamp member 44. The recesses 54 in the top plate 30 are oriented at an angle with respect to the recesses 54 in the bottom plate 32 that corresponds to the relative angular orientation of the flutes 52 of the top band relative to the flutes 52 of the bottom band at the distance separating the top plate 30 and the bottom plate 32. Accordingly, the recesses 54 act like mating female threads to tile male threads that are the flutes 52. Vertical adjustment of the clamp member 44 relative to the housing 28 will thus result in pivotal movement of the claim member 44 about the longitudinal axis of the pin 46 causing the swing arm 48 and thereby the movable jaw 39 to swing or pivot toward and away from the fixed jaw 38 (FIG. 3).

In operation, the panel 24 is positioned so that the fixed jaw 38 is placed inside the channel 40 of the shoring post 16 at the desired position (FIG. 3*c*). The clamp member 44 is then moved downwardly to pivot the movable jaw 48 toward the shoring post 16 (FIG. 3*b*) and then into engagement with the opposing channel 42 (FIG. 3*a*). Typically, a hammer or other tool is used to tap the top end portion of the pin 46 of the clamp member 44 to secure the clamp 26 in its locked position engaging the opposing channels 40 and 42 of the shoring, post 16. The clamp 26 may be quickly and easily released by tapping the bottom end portion of the pin 46 with the hammer or other tool.

Figure 7B:
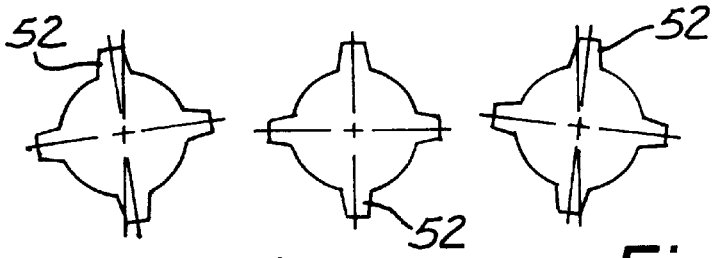

In the preferred embodiment, the flutes 52 are disposed at an angle relative to the longitudinal axis of the pin 46 such that vertical movement of the clamp member 44 will result in the movable jaw pivoting through a predetermined angle. In FIGS. 7A–7C there is illustrated sections of FIG. 6 taken at fixed intervals.

To assure that the movable jaw of the clamp member 44 does not interfere with repositioning or removal of the panel 24, the clamp member 44 may be moved upwardly until the flutes 52 of the top band clear the top plate 30. In this position, clamp member 44 is free to pivot through the full range of motion unrestricted by engagement of the flutes 52 and the recesses 54. Moreover, the clamp member 44 may be pivoted to move the swing arm 48 into alignment with an elongated opening 53 in the top of the housing 28 to allow insertion of the clamp member 44 into the housing. In the preferred embodiment, after the insertion of the clamp member 44, the housing 28 is attached to a rail of the panel 24. The housing 28 is sized so that the rail will extend into the housing 28 a sufficient distance to allow limited pivotal movement of the clamp member 44 through its required operation range yet prevent it from being pivoted so far as to align the swing arm 48 with the opening 53, thereby preventing loss of the clamp member 44 in the field.

Although the invention has been described with respect to a preferred embodiment thereof, it is to be also understood that it is not to be so limited since changes and modifications can be made therein which are within the full intended scope of this invention as defined by the appended claims.

I claim:

1. A clamp for releasably interconnecting two components of a support apparatus, comprising:

(a) a housing secured to a first of the components;

(b) an opening in the housing, having at least one recess formed in the periphery of the opening;

(c) a fixed jaw extending from said housing and adapted to engage a first portion of the second component;

(d) a moveable jaw pivotably mounted to the housing opposite from the fixed jaw and adapted to engage a second portion of the second component;

(e) a clamp member comprising a pin having a pivot axis and received within the opening of the housing and a swing arm extended generally radially from the pin and adapted to engage the moveable jaw; and (f) at least one flute extended generally radially from said pin and disposed at an angle relative to the pivot axis of the pin and received within the recess, whereby movement of the clamp member along the pivot axis of the pin will pivot the swing arm and thereby the moveable jaw toward the fixed jaw to securely engage the second component between the jaws.

2. A clamp as defined in claim 1, wherein the housing comprises:

(a) a pair of opposite side portions;

(b) a pair of aligned openings, one each of which is formed in a corresponding one of the side portions; and (c) at least one recess formed in the periphery of each of the openings.

3. A clamp as defined in claim 2, wherein the pin comprises:

(a) a first end portion received within the opening of a first of the side portions of the housing, and a second end portion received within the opening of a second of the side portions of the housing; and (b) at least two of the flutes, one of which extends from the first end portion of the pin and is received within the recess of the opening in the first side portion of the housing and the second of which extends from the second end portion of the pin and is received within the recess of the opening in the second side portion of the housing.

4. A clamp as defined in claim 2, wherein the housing is generally U-shaped in transverse cross-section comprising a pair of parallel legs sections interconnected by a web, wherein the leg sections comprise the side portions and the fixed jaw extends from the web.

5. A clamp as defined in claim 3, wherein the pin further comprises a central portion between the end portions which central portion is free of flutes whereby axial movement of the pin inside one of the openings in the area of the central portion will permit free pivotal movement of the pin unconstrained by the flutes and recesses.

6. A clamp as defined in claim 5, wherein the swing arm is extended generally radially from the central portion of the pin.

7. A clamp as defined in claim 1, wherein the first and second portions of the second component comprise parallel, opposing channels extended alone the second component and wherein the jaws are adapted to releasably engage the opposing channels at any position along the second component.

8. A clamp as defined in claim 2, wherein the clamp member comprises:

(a) a first end portion of the pin, a second end portion of the pin, and a central portion between the two end portions;

(b) a plurality of the flutes are arranged in parallel rows about the circumferential periphery of the pin in a band within the first end portion and a plurality of the flutes are arranged in parallel rows about the circumferential periphery of the pin in a band within the second end portion;

(c) a plurality of recesses corresponding to tile number and angular position of the flutes at each end portion of the pin are formed in the corresponding openings in the side portions of the housing such that axial movement of the pin inside the openings results in pivotal movement of the moveable jaw through the range of motion wherein the flutes are engaged by the recesses; and (d) wherein the swing arm extends from the central portion.

9. A clamp as defined in claim 8, wherein the central portion on either side of the swing arm is devoid of flutes to allow pivotal movement of the clamp member within the housing unconstrained by the flute members and recesses when the pin has been axially moved to position a side portion of the housing in the area of the central portion that is devoid of flutes.

* * * * *